United States Patent [19]

Maraman, Sr.

[11] Patent Number: 4,844,376

[45] Date of Patent: Jul. 4, 1989

[54] REEL DISPENSER FOR CABLE OR WIRE

[75] Inventor: Ned D. Maraman, Sr., Savannah, Ga.

[73] Assignee: Patents Unlimited, Inc., Savannah, Ga.

[21] Appl. No.: 152,734

[22] Filed: Feb. 5, 1988

[51] Int. Cl.[4] ..... B65H 49/20

[52] U.S. Cl. ..... 242/129

[58] Field of Search ..... 242/129, 128, 85, 86.5 R, 242/105, 106, 103, 54 R

[56] References Cited

U.S. PATENT DOCUMENTS

| | | | |
|---|---|---|---|
| 2,957,643 | 10/1960 | Bosworth et al. | 242/128 |
| 3,186,659 | 6/1965 | Arnold | 242/129 |
| 3,392,960 | 7/1968 | Bye | 242/129 X |
| 3,491,967 | 1/1970 | Sawyer et al. | 242/129 |
| 3,667,699 | 6/1972 | Hobbs et al. | 242/129 |
| 3,780,964 | 12/1973 | Gonzalez | 242/129 |
| 3,831,877 | 8/1974 | Bennett et al. | 242/86.5 R |
| 4,340,193 | 7/1982 | Zitzman | 242/129 X |
| 4,471,651 | 9/1984 | Dimeff et al. | 242/129 X |
| 4,471,921 | 9/1984 | Corbin | 242/129 |

*Primary Examiner*—Stanley N. Gilreath

*Attorney, Agent, or Firm*—Cushman, Darby & Cushman

[57] ABSTRACT

A wire reel dispenser and holder for high tension steel cable. The dispenser includes an inner reel element including first and second side frames coupled together in axially spaced relation for receiving a wire coil therebetween. The assembled reel together with a coil of wire are inserted into an outer support frame which has a centrally disposed shaft corresponding to a hub provided on the inner reel. In this manner, the reel is rotatable within the outer support structure. The outer support structure has an interior height which is at least equal to an preferably greater than the height of the inner reel whereby the inner reel is caged within the outer support frame such that explosion of the high tension steel cable therefrom is prevented. Further, the inner reel and the outer support preferably each include a clamping structure for respectively anchoring opposite longitudinal ends of the wire or cable.

9 Claims, 2 Drawing Sheets

REEL DISPENSER FOR CABLE OR WIRE

BACKGROUND OF THE INVENTION

1. Field of the Invention

The present invention relates to a wire reel dispenser and, more particularly, to a caged cable holder and dispenser which holds and prevents explosion of high tension steel cable and guy wire while allowing easy, stable dispensing of the cable.

2. Related Prior Art

Wire dispensers and carriers on which coiled wire supporting reels are rotatably mounted are well known in the art and are disclosed, for example, in U.S. Pat. Nos. 2,250,269, 2,963,239, 3,070,324, 3,326,495, 3,731,888, 4,006,865, 4,042,187, 4,437,622 and 4,667,897, Russian Pat. No. 128222 and UK Pat. Specification No. 1,357,939. However, special problems are encountered when high tension steel cable or guy wire is coiled under tension and is to be incrementally dispensed from, for example, a line truck for an electric power company or an electric co-op or from a stationary device mounted to the ground or otherwise supported. Indeed, because wire of this type is coiled under high tension, when it is to be uncoiled, it can be place on a reel and when the bands containing the coiled wire are cut, the wire or cable will explode outwardly as the coil tension is released thereby endangering workers mounting the cable as well as passersby unless this action is prevented. Further, the inner end of the cable will loosen presenting a further risk of injury.

The prior art structures disclosed in the patents listed above lack a means for containing the wire as portions are dispensed and lack a means for stabilizing the inside end of the cable. Thus, use of the same for uncoiling coil of high tension wire has the serious disadvantages noted above.

Therefore, it would be desirable to provide a wire or cable holder and dispenser, particularly for coiled high tension steel cable, which cages the wire therewithin to control the explosiveness of the coil as the holding bands are cut and which enables anchoring of the inside end of the steel cable while allowing easy, safe and controlled dispensing of the same.

SUMMARY OF THE INVENTION

It is therefore an object of the present invention to provide a holder and dispenser for high tension steel cable which cages the wire therewithin to control the explosion of the wire when the coil is freed from its restraining bands and allows for anchoring of each end of the steel cable wire while allowing dispensing of the cable when needed.

These and other objects are realized in accordance with the present invention by providing an inner reel member including first and second axially coupled side frame members defining therebetween a cylindrical gap for receiving a coil of wire and an outer frame member including a centrally disposed shaft for mounting and rotatably receiving the inner reel member. The outer frame member has an interior height at least as great as the height of the reel whereby the reel is encapsulated within the outer frame member when mounted thereto. Further, in a preferred embodiment, a structure for lockingly coupling each end of the wire mounted to the reel is provided so that loosening and/or explosion of the wire are beyond the outer frame are prevented.

Other objects, features and characteristics of the present invention, as well as the methods of operation and functions of the related elements of the structure, and the combination of parts and economies of manufacture, will become more apparent upon consideration of the following detailed description and the appended claims with reference to the accompanying drawings all of which form a part of this specification, wherein like reference numerals designate corresponding parts in the various Figures.

DETAILED DESCRIPTION OF THE PRESENTLY PREFERRED EXEMPLARY EMBODIMENT

Figure 1:
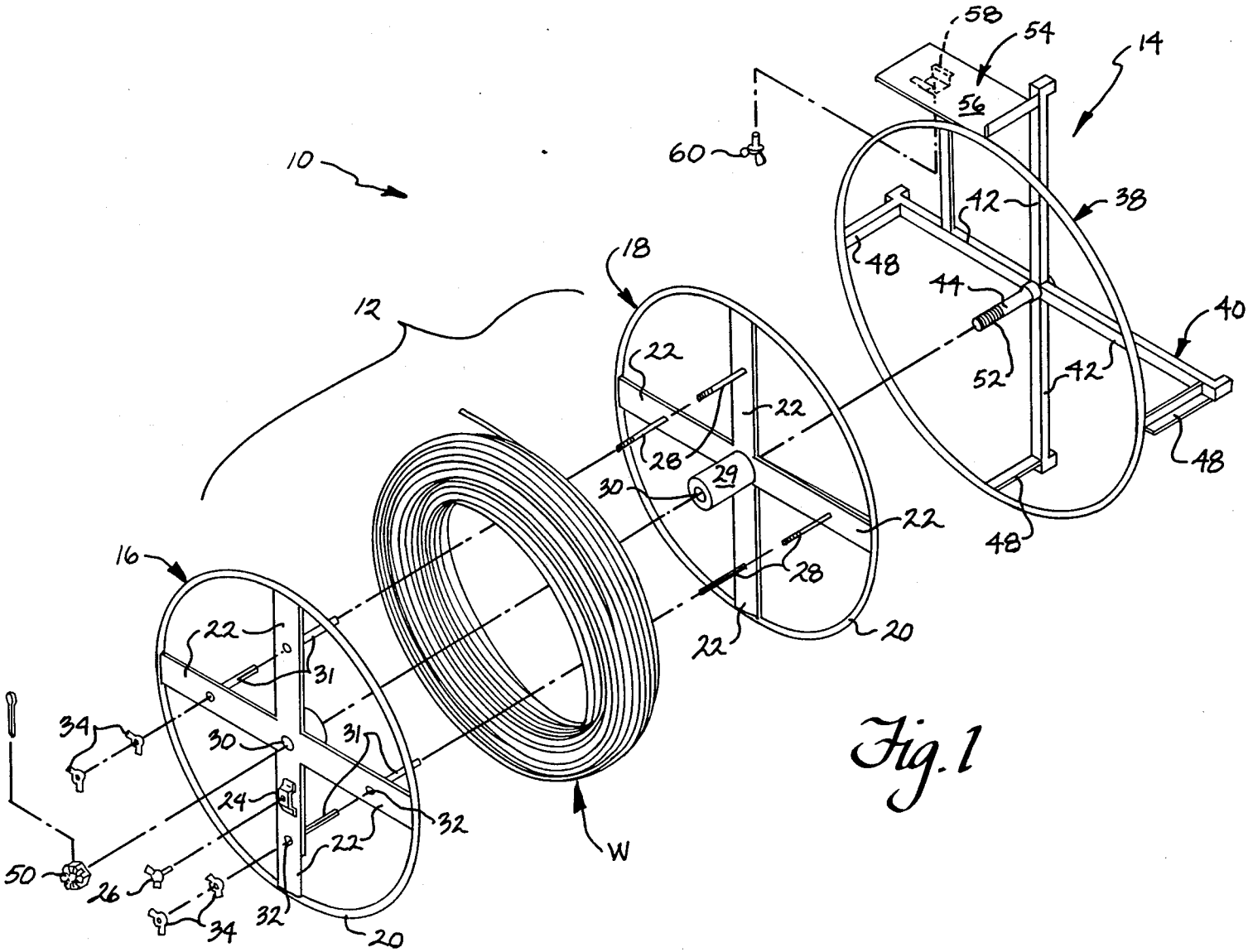
FIG. 1 is an exploded perspective view of a cable holder and dispenser formed in accordance with the present invention.

Referring to FIG. 1, the wire holding and dispensing device 10 of the present invention includes an inner reel assembly 12 for receiving high tension wire and an outer support structure 14.

Inner reel assembly 12 includes first and second side frames, generally indicated at 16 and 18, which are axially coupled together and receive therebetween a high tension wire coil W. Each of the side frames includes an outer, circular rim element 20 and a number of spoke elements 22. In the illustrated embodiment, each side frame 16 and 18 includes four spoke elements though it is to be understood that any number of spokes could be provided and that the angular orientation and shape of such spoke elements can be varied depending upon the number thereof and the users needs. Further, each of the side frames could be a flat plate having no or a limited number of viewing apertures therein. Where spoke elements 22 are provided, however, the number and angular orientation of the spoke elements 22 should be the same on each side frame to facilitate assembly of inner reel 12, as will become more apparent below.

Further, at least one spoke element 22 of side frame 16 preferably includes a bracket 24 or the like and a fly bolt 26 for anchoring one end of the wire mounted within the reel frame 12 thereto, as discussed more fully below.

First and second side frames 16, 18 are interconnected so as to define the inner reel assembly 12 by means of threaded bolts 28 or the like which are mounted to the spokes 22 of one of the side frames (frame 18 in the illustrated embodiment), and extend perpendicularly therefrom towards the other wheel frame member 16. Side frame 18 also includes a hub 29 extending perpendicularly away from the center of the frame through which on aperture 30 extends.

Side frame 16 includes a plurality of cylindrical sleeve members 31 that include an axially extending bore leading to an aperture 32 on each spoke element 22 at a location corresponding to the location of bolts 28 on the spokes of side frame 18. When the reel 12 is to be assembled, the wire coil W is placed over the sleeves 31 and frame 18 is mounted to frame 16 by respectively inserting bolts 28 into apertures 32 so that the same can be secured therewithin by means of wing nuts 34 or the like. As shown, the cylindrical sleeve elements 31 become mounted intermediate the spoke elements of the first and second side frames, about each bolt 28, and maintain the side frames in a predetermined spaced relation. Once reel 12 has been assembled, sleeved bolts 31/28 define an inner cylindrical core structure about which the high tension wire or cable is mounted. While in the illustrated embodiment bolts 31/28 are disposed on spoke element 22 so as to define an inner cylindrical core of a given size, it is to be understood that the particular radial location of sleeved bolts 31/28 can be varied to accommodate coils of various inner diameters.

As shown in FIG. 1, outer support 14 includes an outer rim element 38 and a base frame member 40 including a number of spoke elements 42 extending radially outwardly from a central shaft 44 by approximately equal lengths. Rim element 38 is coupled to the radially outermost portions of spokes 42 of base frame 40 by vertical spacers 48. While in the illustrated embodiment, four spoke elements 42 and four vertical spacers 48 are shown it is to be understood that the particular number of spoke elements 42 and vertical spacers 48 would depend upon the desired strength of the outer cage portion of the wire holder and dispenser and the needs of the particular user. Further, support structure 14 could be formed as a one-piece open ended cylindrical element with an aperture for cable dispensing and, if desired, one or more viewing apertures.

To assemble dispenser 10, reel assembly 12 with a wire W mounted thereto and having a longitudinal end thereof anchored in position by means of bracket 24 and fly bolt 26 is mounted to the outer support structure 14. More particularly, shaft 44 is inserted through aperture 30 in hub 29 of side frame 18 and through a centrally defined aperture 30' in side frame 16. Dispenser 10 is secured together in such an assembled configuration by threading a nut 50 or the like to screw threads 52 provided on the free end of central shaft 44. However, shaft 44 has a length such that reel 12 is free to rotate thereabout within outer support 14. Further, the inner diameter of outer support 14, defined by the inner surface of rim 38 and vertical spacers 48, is greater than the outer diameter of reel 12, defined by the outer diameter of rims 20. Preferably the peripheral gap defined between rim 20 and rim 38 is on the order of about 0.5 to about 2 inches to ensure free rotation of reel 12 relative to support 14. In addition, the overall height of reel 12 is less than the interior depth of outer support 14 so that reel 12 and wire W mounted thereto are caged within outer support 14 once the reel 12 is positioned within outer support 14. In the preferred embodiment, when reel 12 is mounted to support 14, it is recessed from rim 38 at least about 0.5 inches to ensure encapsulation of the reel and cable. In this manner, explosion of the wire out of the holder and dispenser is prevented by the caging/encapsulation effect of outer support 14.

The outer or free end of the high tension wire W mounted within dispenser 10 is preferably anchored to outer support 14. More particularly, a secondary support element 54 extends from at least one of the spoke members 42 and supports a plate element 56 or the like having a bracket 58 (shown in phantom lines) for receiving the free end of the wire. The wire is clamped within this bracket by means of a fly bolt 60 or the like. Thus, if wire is needed the free end of the wire is gripped, fly bolt 60 loosened and the wire pulled from dispenser 10. Once a desired length of wire W has been pulled from dispenser 10 in this manner, fly bolt 60 is tightened and the wire subsequently cut. Thus, fly bolts 26 and 60 provided for each end of the wound wire W will prevent loosening or explosion of the wire within dispenser 10 itself.

Figure 2:
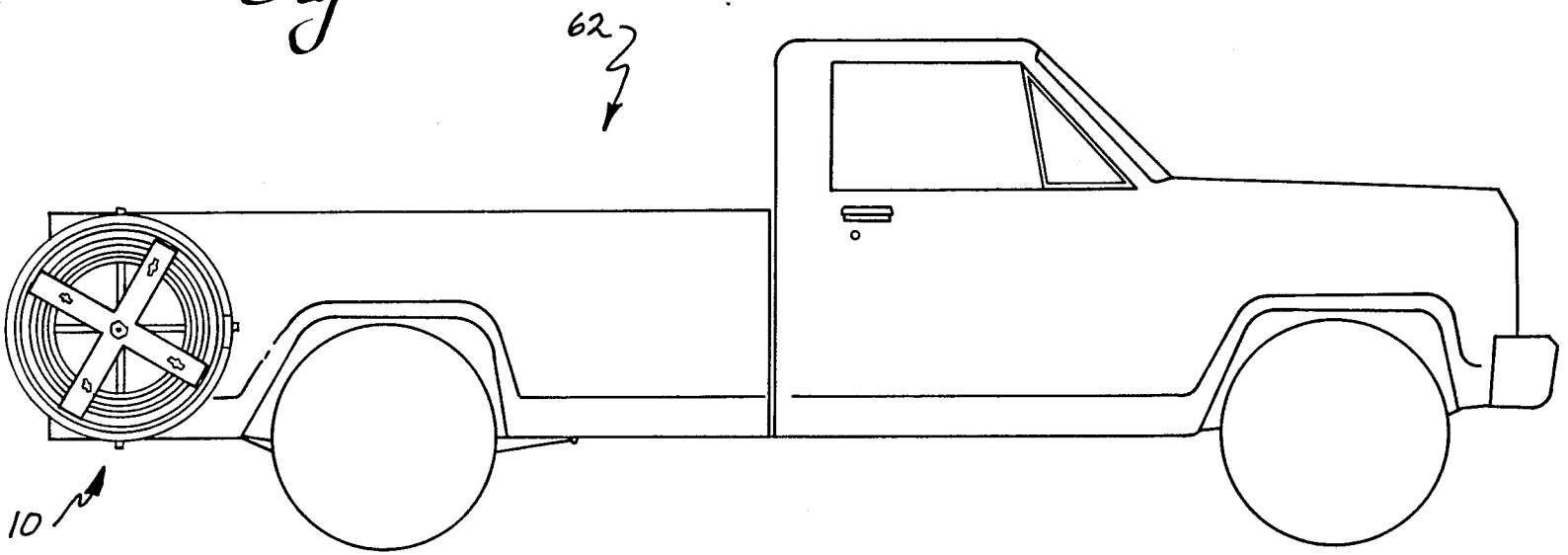
FIG. 2 is a side elevational view schematically illustrating a manner in which the wire coil unwinder of the present invention can be mounted to a vehicle for guying the wire to a location where it is to be dispensed and mounted.

Referring to FIG. 2, the assembled wire dispenser 10 can be mounted for example to a line truck 62 so that it can be carried from location to location as needed. It is to be understood, however, that the wire reel holder and dispenser 10 of the present invention need not be mounted to such a moving vehicle but may be mounted to a wall, used in a stationary manner on the floor, or to some other support or may be provided with wheels or the like for mobility.

While the invention has been described in connection with what is presently considered to be the most practical and preferred embodiment, it is to be understood that the invention is not limited to the disclosed embodiment but, on the contrary, is intended to cover various modifications and equivalent arrangements included within the spirit and scope of the appended claims.

What is claimed is:

1. A wire coil holder and dispenser comprising:

an inner reel member including first and second axially coupled side frame members spaced apart a predetermined amount so as to define therebetween a wire coil receiving gap and an overall axial height of said inner reel member, said first and second side frame members being axially coupled by means of a plurality of coupling bolts mounted to one of said side frame members and correspondingly disposed apertures defined in the other of said side frame members for receiving said bolts of said one side frame member, means for securing at least one of said bolt elements within said corresponding aperture, and means for maintaining said side frame members in spaced apart relation provided intermediate said first and second side frames;

a cylindrical outer support frame member having an open axial end and closed axial end with an axially extending shaft member centrally mounted thereto for rotatably receiving said inner reel member, said outer support frame member having a cross-section greater than the cross-section of said inner reel member so as to receive said inner reel member therewithin, said outer support frame member having an internal axial height at east as great as said overall axial height of said inner reel ember whereby said outer support frame member surrounds and encloses said gap defined by said inner reel member.

2. A wire coil holder and dispenser as in claim 1, further comprising means for fixedly securing a first end of a length of wire wrapped about said reel; and means for fixedly securing an opposite longitudinal end of the wire to said outer support frame member.

3. A wire coil holder and dispenser as in claim 1, wherein said side frame members each include an outer rim element and means defining internal reinforcing for said outer rim element.

4. A wire coil holder and dispenser as in claim 3, wherein a said coupling bolt is mounted to said internal reinforcing means of said one side frame and a corresponding aperture is defined in a corresponding internal reinforcing means of the other of said side frame members.

5. A wire coil holder and dispenser as in claim 3, wherein said internal reinforcing means comprises a plurality of radially extending spokes.

6. A wire coil holder and dispenser as in claim 1, wherein said cylindrical outer support frame member includes an outer circumferential rim element and a base frame member having a plurality of spoke elements extending radially from said shaft member by a substantially equal amount, a plurality of vertical spacers mounted intermediate said circumferential rim element and radially outermost portions of said spoke elements so as to define a open ended cylindrical support frame member for receiving said reel member therewithin.

7. A wire coil holder and dispenser as in claim 1, wherein a centrally disposed hub element is mounted intermediate said first and second side frame members and said side frame members each include a centrally disposed aperture for receiving said shaft member of said outer support frame member whereby when said wire coil holder and dispenser is assembled said shaft member extends through said apertures and through said centrally disposed hub element so that, said reel member is rotatable relative to said shaft member.

8. A wire coil holder and dispenser as in claim 1, wherein said means for maintaining said side frame members in spaced apart relation includes sleeve elements provided about each said bolt member intermediate said first and second side frames.

9. A wire coil holder and dispenser comprising:

an inner reel member including first and second axially coupled side frame members spaced apart a predetermined amount so as to define therebetween a wire coil receiving gap and an overall axial height of said inner reel member, said first and second side frame members being axially coupled by means of a plurality of coupling bolts mounted to one of said side frame members and correspondingly disposed apertures defined in the other of said side frame members for receiving said bolts of said one side frame member, and means for securing said bolt elements within said corresponding apertures, and wherein said side frame members are maintained in spaced apart relation by sleeve elements provided about each said bolt member intermediate said first second side frames; and a cylindrical outer support frame member having an open axial end and a closed axial end with an axially extending shaft member centrally mounted thereto for rotatably receiving said inner reel member, said outer support frame member having a cross-section greater than the cross-section of said inner reel member so as to receive said inner reel member therewithin, said outer support frame member having an internal axial height at least as great as said overall axial height of said inner reel member whereby said outer support frame member surrounds and encloses said gap defined by said inner reel member.

* * * * *